US007506481B2

(12) United States Patent
Grafenauer

(10) Patent No.: US 7,506,481 B2
(45) Date of Patent: Mar. 24, 2009

(54) BUILDING BOARD FOR USE IN SUBFLOORS

(75) Inventor: Thomas Grafenauer, Onzour sur Loire (FR)

(73) Assignee: Kronotec AG, Lucerne (CH)

( * ) Notice: Subject to any disclaimer, the term of this patent is extended or adjusted under 35 U.S.C. 154(b) by 457 days.

(21) Appl. No.: 10/736,702

(22) Filed: Dec. 17, 2003

(65) Prior Publication Data

US 2005/0144878 A1 Jul. 7, 2005

(51) Int. Cl.
*E04F 13/08* (2006.01)

(52) U.S. Cl. ..... 52/592.1; 52/592.4

(58) Field of Classification Search ..... 52/591.3, 52/591.1, 589.1, 592.1, 578, 588.1, 591.2, 52/591.4, 592.2, 592.4
See application file for complete search history.

(56) References Cited

U.S. PATENT DOCUMENTS

| | | | | |
|---|---|---|---|---|
| 213,740 | A | 4/1879 | Conner | |
| 347,425 | A * | 8/1886 | Hall | 52/391 |
| 623,562 | A | 4/1899 | Rider | |
| 714,987 | A | 12/1902 | Wolfe | |
| 753,791 | A | 3/1904 | Fulghum | |
| 1,124,228 | A | 1/1915 | Houston | |
| 1,407,679 | A | 2/1922 | Ruthrauff | |
| 1,454,250 | A | 5/1923 | Parsons | |
| 1,468,288 | A | 9/1923 | Een | |
| 1,477,813 | A | 12/1923 | Daniels | |
| 1,510,924 | A | 10/1924 | Daniels et al. | |
| 1,540,128 | A | 6/1925 | Houston | |
| 1,551,544 | A | 9/1925 | Crooks | |
| 1,575,821 | A | 3/1926 | Daniels | |
| 1,602,256 | A | 10/1926 | Sellin | |
| 1,602,267 | A | 10/1926 | Karwisch | |
| 1,615,096 | A | 1/1927 | Meyers | |
| 1,622,103 | A | 3/1927 | Fulton | |

(Continued)

FOREIGN PATENT DOCUMENTS

| | | |
|---|---|---|
| AT | 005566 | 8/2002 |

(Continued)

OTHER PUBLICATIONS

Webster Dictionary, p. 862.

(Continued)

*Primary Examiner*—Brian E. Glessner
*Assistant Examiner*—Christine T Cajilig
(74) *Attorney, Agent, or Firm*—Greenblum & Bernstein, P.L.C.

(57) ABSTRACT

A building board made of OSB (oriented strand board) which can be laid on beams, which are spaced apart parallel to one another, in order to form a subfloor in a residential or commercial building and which has two mutually opposite longitudinal edges and two mutually opposite transverse edges running at right angles to the longitudinal edges. One longitudinal edge and one transverse edge in each case has a tongue and the opposite longitudinal edge and transverse edge has a groove corresponding to the tongue, via which a plurality of building boards can be connected to one another and locked in the vertical direction in relation to one another. The tongue and the groove on the longitudinal edge are designed such that two boards which are connected to one another at the longitudinal edges are also locked in a horizontal direction in relation to one another.

20 Claims, 2 Drawing Sheets

U.S. PATENT DOCUMENTS

| | | | | |
|---|---|---|---|---|
| 1,622,104 | A | | 3/1927 | Fulton |
| 1,637,634 | A | | 8/1927 | Carter |
| 1,644,710 | A | | 10/1927 | Crooks |
| 1,660,480 | A | | 2/1928 | Daniels |
| 1,714,738 | A | | 5/1929 | Smith |
| 1,718,702 | A | | 6/1929 | Pfiester |
| 1,734,826 | A | | 11/1929 | Pick |
| 1,764,331 | A | | 6/1930 | Moratz |
| 1,776,188 | A | | 9/1930 | Langb'aum |
| 1,778,069 | A | | 10/1930 | Fetz |
| 1,779,729 | A | | 10/1930 | Bruce |
| 1,787,027 | A | | 12/1930 | Wasleff |
| 1,823,039 | A | | 9/1931 | Gruner |
| 1,859,667 | A | | 5/1932 | Gruner |
| 1,898,364 | A | | 2/1933 | Gynn |
| 1,906,411 | A | | 5/1933 | Potvin |
| 1,921,164 | A | | 8/1933 | Lewis |
| 1,929,871 | A | | 10/1933 | Jones |
| 1,940,377 | A | | 12/1933 | Storm |
| 1,946,648 | A | | 2/1934 | Taylor |
| 1,953,306 | A | | 4/1934 | Moratz |
| 1,986,739 | A | | 1/1935 | Mitte |
| 1,988,201 | A | | 1/1935 | Hall |
| 2,023,066 | A | | 12/1935 | Curtis et al. |
| 2,044,216 | A | | 6/1936 | Klages |
| 2,065,525 | A | | 12/1936 | Hamilton |
| 2,123,409 | A | | 7/1938 | Elmendorf |
| 2,220,606 | A | | 11/1940 | Malarkey et al. |
| 2,276,071 | A | | 3/1942 | Scull |
| 2,280,071 | A | | 4/1942 | Hamilton |
| 2,324,628 | A | | 7/1943 | Kähr |
| 2,328,051 | A | | 8/1943 | Bull |
| 2,398,632 | A | | 4/1946 | Frost et al. |
| 2,430,200 | A | | 11/1947 | Wilson |
| 2,740,167 | A | | 4/1956 | Rowley |
| 2,894,292 | A | | 7/1959 | Gramelspacker |
| 3,045,294 | A | | 7/1962 | Livezey, Jr. |
| 3,100,556 | A | | 8/1963 | De Ridder |
| 3,125,138 | A | | 3/1964 | Bolenbach |
| 3,182,769 | A | | 5/1965 | De Ridder |
| 3,203,149 | A | | 8/1965 | Soddy |
| 3,204,380 | A | | 9/1965 | Smith et al. |
| 3,267,630 | A | | 8/1966 | Omholt |
| 3,282,010 | A | | 11/1966 | King, Jr. |
| 3,310,919 | A | | 3/1967 | Bue et al. |
| 3,347,048 | A | | 10/1967 | Brown et al. |
| 3,460,304 | A | | 8/1969 | Braeuninger et al. |
| 3,481,810 | A | | 12/1969 | Waite |
| 3,526,420 | A | | 9/1970 | Brancaleone |
| 3,538,665 | A | | 11/1970 | Gohner |
| 3,553,919 | A | | 1/1971 | Omholt |
| 3,555,762 | A | | 1/1971 | Costanzo, Jr. |
| 3,608,258 | A | | 9/1971 | Spratt |
| 3,694,983 | A | | 10/1972 | Couquet |
| 3,714,747 | A | | 2/1973 | Curran |
| 3,720,027 | A | | 3/1973 | Christensen |
| 3,731,445 | A | | 5/1973 | Hoffmann et al. |
| 3,759,007 | A | | 9/1973 | Thiele |
| 3,760,548 | A | | 9/1973 | Sauer et al. |
| 3,768,846 | A | | 10/1973 | Hensley et al. |
| 3,807,113 | A | * | 4/1974 | Turner ..... 52/314 |
| 3,859,000 | A | | 1/1975 | Webster |
| 3,878,030 | A | | 4/1975 | Cook |
| 3,902,293 | A | | 9/1975 | Witt et al. |
| 3,908,053 | A | | 9/1975 | Hettich |
| 3,936,551 | A | | 2/1976 | Elmendorf et al. |
| 3,988,187 | A | | 10/1976 | Witt et al. |
| 4,006,048 | A | | 2/1977 | Cannady, Jr. et al. |
| 4,090,338 | A | | 5/1978 | Bourgade |
| 4,091,136 | A | | 5/1978 | O'Brian et al. |
| 4,099,358 | A | | 7/1978 | Compaan |
| 4,118,533 | A | | 10/1978 | Hipchen et al. |
| 4,131,705 | A | | 12/1978 | Kubinsky |
| 4,164,832 | A | | 8/1979 | Van Zandt |
| 4,169,688 | A | | 10/1979 | Toshio |
| 4,242,390 | A | | 12/1980 | Nemeth |
| 4,243,716 | A | | 1/1981 | Kosaka et al. |
| 4,245,689 | A | | 1/1981 | Grard et al. |
| 4,246,310 | A | | 1/1981 | Hunt et al. |
| 4,290,248 | A | | 9/1981 | Kemerer et al. |
| 4,299,070 | A | | 11/1981 | Oltmanns et al. |
| 4,426,820 | A | * | 1/1984 | Terbrack et al. ..... 52/590.1 |
| 4,431,044 | A | | 2/1984 | Bruneau |
| 4,471,012 | A | | 9/1984 | Maxwell |
| 4,501,102 | A | | 2/1985 | Knowles |
| 4,561,233 | A | | 12/1985 | Harter et al. |
| 4,585,685 | A | | 4/1986 | Forry et al. |
| 4,612,745 | A | | 9/1986 | Hovde |
| 4,641,469 | A | | 2/1987 | Wood |
| 4,653,242 | A | | 3/1987 | Ezard |
| 4,654,244 | A | | 3/1987 | Eckert et al. |
| 4,703,597 | A | | 11/1987 | Eggemar |
| 4,715,162 | A | | 12/1987 | Brightwell |
| 4,738,071 | A | | 4/1988 | Ezard |
| 4,752,497 | A | | 6/1988 | McConkey et al. |
| 4,769,963 | A | | 9/1988 | Meyerson |
| 4,819,932 | A | | 4/1989 | Trotter, Jr. |
| 4,831,806 | A | | 5/1989 | Niese et al. |
| 4,845,907 | A | | 7/1989 | Meek |
| 4,905,442 | A | | 3/1990 | Daniels |
| 4,947,602 | A | | 8/1990 | Pollasky |
| 5,029,425 | A | | 7/1991 | Bogataj |
| 5,103,614 | A | | 4/1992 | Kawaguchi et al. |
| 5,113,632 | A | | 5/1992 | Hanson |
| 5,117,603 | A | | 6/1992 | Weintraub |
| 5,136,823 | A | | 8/1992 | Pellegrino |
| 5,165,816 | A | | 11/1992 | Parasin |
| 5,179,812 | A | | 1/1993 | Hill |
| 5,205,091 | A | | 4/1993 | Brown |
| 5,216,861 | A | | 6/1993 | Meyerson |
| 5,251,996 | A | | 10/1993 | Hiller et al. |
| 5,253,464 | A | | 10/1993 | Nilsen |
| 5,283,102 | A | | 2/1994 | Sweet et al. |
| 5,295,341 | A | | 3/1994 | Kajiwara |
| 5,335,473 | A | | 8/1994 | Chase |
| 5,348,778 | A | | 9/1994 | Knipp et al. |
| 5,349,796 | A | | 9/1994 | Meyerson |
| 5,390,457 | A | | 2/1995 | Sjölander |
| 5,413,834 | A | | 5/1995 | Hunter et al. |
| 5,433,806 | A | | 7/1995 | Pasquali et al. |
| 5,474,831 | A | | 12/1995 | Nystrom |
| 5,497,589 | A | | 3/1996 | Porter |
| 5,502,939 | A | | 4/1996 | Zadok et al. |
| 5,540,025 | A | | 7/1996 | Takehara et al. |
| 5,567,497 | A | | 10/1996 | Zegler et al. |
| 5,570,554 | A | | 11/1996 | Searer |
| 5,597,024 | A | | 1/1997 | Bolyard et al. |
| 5,630,304 | A | | 5/1997 | Austin |
| 5,653,099 | A | | 8/1997 | MacKenzie |
| 5,671,575 | A | | 9/1997 | Wu |
| 5,694,734 | A | | 12/1997 | Cercone et al. |
| 5,706,621 | A | | 1/1998 | Pervan |
| 5,736,227 | A | | 4/1998 | Sweet et al. |
| 5,768,850 | A | | 6/1998 | Chen |
| 5,797,175 | A | | 8/1998 | Schneider |
| 5,797,237 | A | | 8/1998 | Finkell, Jr. |
| 5,823,240 | A | | 10/1998 | Bolyard et al. |
| 5,827,592 | A | | 10/1998 | Van Gulik et al. |
| 5,860,267 | A | | 1/1999 | Pervan |
| 5,935,668 | A | | 8/1999 | Smith |
| 5,943,239 | A | | 8/1999 | Shamblin et al. |
| 5,953,878 | A | | 9/1999 | Johnson |
| 5,968,625 | A | | 10/1999 | Hudson |
| 5,985,397 | A | | 11/1999 | Witt et al. |

5,987,839 A 11/1999 Hamar et al.
6,006,486 A 12/1999 Moriau et al.
6,012,255 A * 1/2000 Smid et al. ..... 52/105
6,023,907 A 2/2000 Pervan
6,065,262 A 5/2000 Motta
6,094,882 A 8/2000 Pervan
6,101,778 A 8/2000 Mårtensson
6,119,423 A 9/2000 Costantino
6,134,854 A 10/2000 Stanchfield
6,148,884 A 11/2000 Bolyard et al.
6,168,866 B1 1/2001 Clark
6,182,410 B1 2/2001 Pervan
6,186,703 B1 2/2001 Shaw
6,205,639 B1 3/2001 Pervan
6,209,278 B1 4/2001 Tychsen
6,216,403 B1 4/2001 Belbeoc'h
6,216,409 B1 4/2001 Roy et al.
D442,296 S 5/2001 Külik
D442,297 S 5/2001 Külik
D442,298 S 5/2001 Külik
D442,706 S 5/2001 Külik
D442,707 S 5/2001 Külik
6,224,698 B1 5/2001 Endo
6,238,798 B1 5/2001 Kang et al.
6,247,285 B1 6/2001 Moebus
D449,119 S 10/2001 Külik
D449,391 S 10/2001 Külik
D449,392 S 10/2001 Külik
6,324,803 B1 12/2001 Pervan
6,345,481 B1 2/2002 Nelson
6,363,677 B1 4/2002 Chen et al.
6,385,936 B1 * 5/2002 Schneider ..... 52/589.1
6,397,547 B1 6/2002 Martensson
6,418,683 B1 7/2002 Martensson et al.
6,421,970 B1 7/2002 Martensson et al.
6,427,408 B1 8/2002 Krieger
6,436,159 B1 8/2002 Safta et al.
6,438,919 B1 8/2002 Knauseder
6,446,405 B1 9/2002 Pervan
6,449,913 B1 9/2002 Shelton
6,449,918 B1 9/2002 Nelson
6,453,632 B1 9/2002 Huang
6,458,232 B1 10/2002 Valentinsson
6,460,306 B1 10/2002 Nelson
6,461,636 B1 10/2002 Arth et al.
6,465,046 B1 10/2002 Hansson et al.
6,490,836 B1 12/2002 Moriau et al.
6,497,961 B2 12/2002 Kang et al.
6,505,452 B1 * 1/2003 Hannig et al. ..... 52/582.1
6,510,665 B2 1/2003 Pervan
6,516,579 B1 2/2003 Pervan
6,517,935 B1 2/2003 Kornfalt et al.
6,519,912 B1 2/2003 Eckmann et al.
6,521,314 B2 2/2003 Tychsen
6,532,709 B2 3/2003 Pervan
6,533,855 B1 3/2003 Gaynor et al.
6,536,178 B1 3/2003 Pålsson et al.
6,546,691 B2 4/2003 Peopolder
6,553,724 B1 4/2003 Bigler
6,558,754 B1 5/2003 Velin et al.
6,565,919 B1 5/2003 Hansson et al.
6,569,272 B2 5/2003 Tychsen
6,588,166 B2 7/2003 Martensson et al.
6,591,568 B1 7/2003 Palsson
6,601,359 B2 8/2003 Olofsson
6,606,834 B2 8/2003 Martensson et al.
6,617,009 B1 9/2003 Chen et al.
6,635,174 B1 10/2003 Berg et al.
6,641,629 B2 11/2003 Safta et al.
6,646,088 B2 11/2003 Fan et al.
6,647,690 B1 11/2003 Martensson
6,649,687 B1 11/2003 Gheewala et al.
6,659,097 B1 12/2003 Houston
6,672,030 B2 1/2004 Schulte
6,675,545 B2 1/2004 Chen et al.
6,681,820 B2 1/2004 Olofsson
6,682,254 B1 * 1/2004 Olofsson et al. ..... 403/375
6,685,993 B1 2/2004 Hansson et al.
6,711,864 B2 3/2004 Erwin
6,711,869 B2 3/2004 Tychsen
6,715,253 B2 4/2004 Pervan
6,723,438 B2 4/2004 Chang et al.
6,729,091 B1 5/2004 Martensson
6,745,534 B2 6/2004 Kornfalt
6,761,008 B2 7/2004 Chen et al.
6,761,794 B2 7/2004 Mott et al.
6,763,643 B1 7/2004 Martensson
6,766,622 B1 7/2004 Thiers
6,769,217 B2 8/2004 Nelson
6,769,218 B2 8/2004 Pervan
6,769,835 B2 8/2004 Stridsman
6,772,568 B2 8/2004 Thiers et al.
6,786,019 B2 9/2004 Thiers
6,803,109 B2 10/2004 Qiu et al.
6,805,951 B2 10/2004 Kornfält et al.
6,823,638 B2 11/2004 Stanchfield
6,841,023 B2 1/2005 Mott
2001/0029720 A1 10/2001 Pervan
2001/0034992 A1 11/2001 Pietzer et al.
2002/0007608 A1 1/2002 Pervan
2002/0007609 A1 1/2002 Pervan
2002/0014047 A1 2/2002 Thiers
2002/0020127 A1 2/2002 Thiers et al.
2002/0046528 A1 4/2002 Pervan et al.
2002/0056245 A1 * 5/2002 Thiers ..... 52/589.1
2002/0106439 A1 8/2002 Cappelle
2002/0160680 A1 10/2002 Laurence et al.
2003/0024200 A1 2/2003 Moriau et al.
2003/0024201 A1 2/2003 Moriau et al.
2003/0029115 A1 2/2003 Moriau et al.
2003/0029116 A1 2/2003 Moriau et al.
2003/0029117 A1 2/2003 Moriau et al.
2003/0033777 A1 2/2003 Thiers et al.
2003/0033784 A1 2/2003 Pervan
2003/0035921 A1 * 2/2003 Kornicer et al. ..... 428/107
2003/0037504 A1 * 2/2003 Schwitte et al. ..... 52/586.1
2003/0079820 A1 * 5/2003 Palsson et al. ..... 156/91
2003/0115812 A1 6/2003 Pervan
2003/0115821 A1 6/2003 Pervan
2003/0159385 A1 8/2003 Thiers
2003/0167717 A1 9/2003 Garcia
2003/0196405 A1 10/2003 Pervan
2003/0205013 A1 11/2003 Garcia
2003/0233809 A1 12/2003 Pervan
2004/0016196 A1 1/2004 Pervan
2004/0035078 A1 2/2004 Pervan
2004/0092006 A1 5/2004 Lindekens et al.
2004/0105994 A1 6/2004 Lu et al.
2004/0139678 A1 7/2004 Pervan
2004/0159066 A1 8/2004 Thiers et al.
2004/0177584 A1 9/2004 Pervan
2004/0200165 A1 10/2004 Garcia et al.
2004/0206036 A1 10/2004 Pervan
2004/0237447 A1 12/2004 Thiers et al.
2004/0237448 A1 12/2004 Thiers et al.
2004/0241374 A1 12/2004 Thiers et al.
2004/0244322 A1 12/2004 Thiers et al.
2004/0250493 A1 12/2004 Thiers et al.
2004/0255541 A1 12/2004 Thiers et al.
2004/0258907 A1 12/2004 Kornfalt et al.
2005/0003149 A1 1/2005 Kornfalt et al.
2005/0016099 A1 1/2005 Thiers

FOREIGN PATENT DOCUMENTS

AU 713628 5/1998

| | | |
|---|---|---|
| AU | 200020703 | 1/2000 |
| BE | 417526 | 9/1936 |
| BE | 557844 | 6/1957 |
| BE | 557844 | 3/1960 |
| BE | 09600527 | 6/1998 |
| BE | 09700344 | 10/1998 |
| CA | 991373 | 6/1976 |
| CA | 2226286 | 12/1997 |
| CA | 2252791 | 5/1999 |
| CA | 2289309 | 7/2000 |
| CH | 200949 | 1/1939 |
| CH | 211877 | 1/1941 |
| CH | 562377 | 5/1975 |
| DE | 314207 | 9/1919 |
| DE | 531989 | 8/1931 |
| DE | 740235 | 10/1943 |
| DE | 1089966 | 9/1960 |
| DE | 1534278 | 2/1966 |
| DE | 1212225 | 3/1966 |
| DE | 1212275 | 3/1966 |
| DE | 1534802 | 4/1970 |
| DE | 7102476 | 6/1971 |
| DE | 2007129 | 9/1971 |
| DE | 1534278 | 11/1971 |
| DE | 2252643 | 10/1972 |
| DE | 2238660 | 2/1974 |
| DE | 7402354 | 5/1974 |
| DE | 2502992 | 7/1976 |
| DE | 2616077 | 10/1977 |
| DE | 2917025 | 11/1980 |
| DE | 7911924 | 3/1981 |
| DE | 7928703 | 5/1981 |
| DE | 3041781 | 6/1982 |
| DE | 3214207 | 11/1982 |
| DE | 8226153 | 1/1983 |
| DE | 3343601 | 6/1985 |
| DE | 86040049 | 6/1986 |
| DE | 3512204 | 10/1986 |
| DE | 3246376 | 2/1987 |
| DE | 3544845 | 6/1987 |
| DE | 4004891 | 9/1990 |
| DE | 4002547 | 8/1991 |
| DE | 4134452 | 4/1993 |
| DE | 4215273 | 11/1993 |
| DE | 4242530 | 6/1994 |
| DE | 4011656 | 1/1995 |
| DE | 4324137 | 1/1995 |
| DE | 4107151 | 2/1995 |
| DE | 29517128 | 2/1996 |
| DE | 4242530 | 9/1996 |
| DE | 3544845 | 12/1996 |
| DE | 29710175 | 9/1997 |
| DE | 19616510 | 3/1998 |
| DE | 19651149 | 6/1998 |
| DE | 19709641 | 9/1998 |
| DE | 19718319 | 11/1998 |
| DE | 19735189 | 6/2000 |
| DE | 20001225 | 8/2000 |
| DE | 19925248 | 12/2000 |
| DE | 20017461 | 3/2001 |
| DE | 20018284 | 3/2001 |
| DE | 20206460 | 8/2002 |
| DE | 20218331 | 5/2004 |
| EP | 0248127 | 12/1987 |
| EP | 0623724 | 11/1994 |
| EP | 0652340 | 5/1995 |
| EP | 0667936 | 8/1995 |
| EP | 0690185 | 1/1996 |
| EP | 0849416 | 6/1998 |
| EP | 0698162 | 9/1998 |
| EP | 0903451 | 3/1999 |
| EP | 0855482 | 12/1999 |
| EP | 0877130 | 1/2000 |
| EP | 0969163 | 1/2000 |
| EP | 0969164 | 1/2000 |
| EP | 0974713 | 1/2000 |
| EP | 0843763 | 10/2000 |
| EP | 1200690 | 5/2002 |
| EP | 0958441 | 7/2003 |
| EP | 1026341 | 8/2003 |
| ES | 163421 | 9/1968 |
| ES | 460194 | 5/1978 |
| ES | 283331 | 5/1985 |
| ES | 1019585 | 12/1991 |
| ES | 1019585 | 4/1992 |
| ES | 2168045 | 5/2002 |
| FI | 843060 | 8/1984 |
| FR | 1293043 | 4/1962 |
| FR | 2568295 | 5/1986 |
| FR | 2623544 | 5/1989 |
| FR | 2630149 | 10/1989 |
| FR | 2637932 | 4/1990 |
| FR | 2675174 | 10/1991 |
| FR | 2667639 | 4/1992 |
| FR | 2691491 | 11/1993 |
| FR | 2697275 | 4/1994 |
| FR | 2712329 | 5/1995 |
| FR | 2776956 | 10/1999 |
| FR | 2781513 | 1/2000 |
| FR | 2785633 | 5/2000 |
| GB | 424057 | 2/1935 |
| GB | 585205 | 1/1947 |
| GB | 599793 | 3/1948 |
| GB | 636423 | 4/1950 |
| GB | 812671 | 4/1959 |
| GB | 1033866 | 6/1966 |
| GB | 1034117 | 6/1966 |
| GB | 1044846 | 10/1966 |
| GB | 1237744 | 6/1968 |
| GB | 1127915 | 9/1968 |
| GB | 1275511 | 5/1972 |
| GB | 1399402 | 7/1975 |
| GB | 1430423 | 3/1976 |
| GB | 2117813 | 10/1983 |
| GB | 2126106 | 3/1984 |
| GB | 2152063 | 7/1985 |
| GB | 2238660 | 6/1991 |
| GB | 2243381 | 10/1991 |
| GB | 2256023 | 11/1992 |
| JP | 54-65528 | 5/1979 |
| JP | 57-119056 | 7/1982 |
| JP | 59-186336 | 10/1984 |
| JP | 3-169967 | 7/1991 |
| JP | 4-106264 | 4/1992 |
| JP | 5-148984 | 6/1993 |
| JP | 6-56310 | 5/1994 |
| JP | 6-146553 | 5/1994 |
| JP | 6-200611 | 7/1994 |
| JP | 6-320510 | 11/1994 |
| JP | 7-76923 | 3/1995 |
| JP | 7-180333 | 7/1995 |
| JP | 7-300979 | 11/1995 |
| JP | 7-310426 | 11/1995 |
| JP | 8-109734 | 4/1996 |
| JP | 8-270193 | 10/1996 |
| NE | 7601773 | 2/1976 |
| NO | 157871 | 2/1988 |
| NO | 305614 | 6/1999 |
| SE | 20049 | 11/1939 |
| SE | 7114900-9 | 9/1974 |
| SE | 450411 | 6/1987 |
| SE | 450141 | 9/1987 |
| SE | 501014 | 10/1994 |
| SE | 501914 | 6/1995 |
| SE | 502994 | 4/1996 |
| SE | 506254 | 11/1997 |

| | | |
|---|---|---|
| SE | 509059 | 11/1998 |
| SE | 509060 | 11/1998 |
| SE | 51290 | 2/2000 |
| SE | 512290 | 2/2000 |
| SE | 512313 | 2/2000 |
| SE | 0000200-6 | 8/2001 |
| SU | 363795 | 12/1972 |
| WO | 84/02155 | 6/1984 |
| WO | 87/03839 | 7/1987 |
| WO | 89/08539 | 9/1989 |
| WO | 92/17657 | 10/1992 |
| WO | 93/13280 | 7/1993 |
| WO | 93/19910 | 10/1993 |
| WO | 94/01628 | 1/1994 |
| WO | 94/26999 | 11/1994 |
| WO | 9426999 | 11/1994 |
| WO | 95/06176 | 3/1995 |
| WO | 96/27719 | 9/1996 |
| WO | 96/27721 | 9/1996 |
| WO | 96/30177 | 10/1996 |
| WO | 97/47834 | 12/1997 |
| WO | 98/24495 | 6/1998 |
| WO | 98/24994 | 6/1998 |
| WO | 98/38401 | 9/1998 |
| WO | 99/40273 | 8/1999 |
| WO | 9940273 | 8/1999 |
| WO | 99/66151 | 12/1999 |
| WO | 99/66152 | 12/1999 |
| WO | 9966152 | 12/1999 |
| WO | 00/06854 | 2/2000 |
| WO | 0006854 | 2/2000 |
| WO | 00/66856 | 11/2000 |
| WO | 0066856 | 11/2000 |
| WO | 01/66876 | 9/2001 |
| WO | 0166876 | 9/2001 |

OTHER PUBLICATIONS

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc. et al.* vs. *International Trade Commission and Pergs, Inc. et al.* decided Sep. 10, 2003.

* cited by examiner

Fig. 3
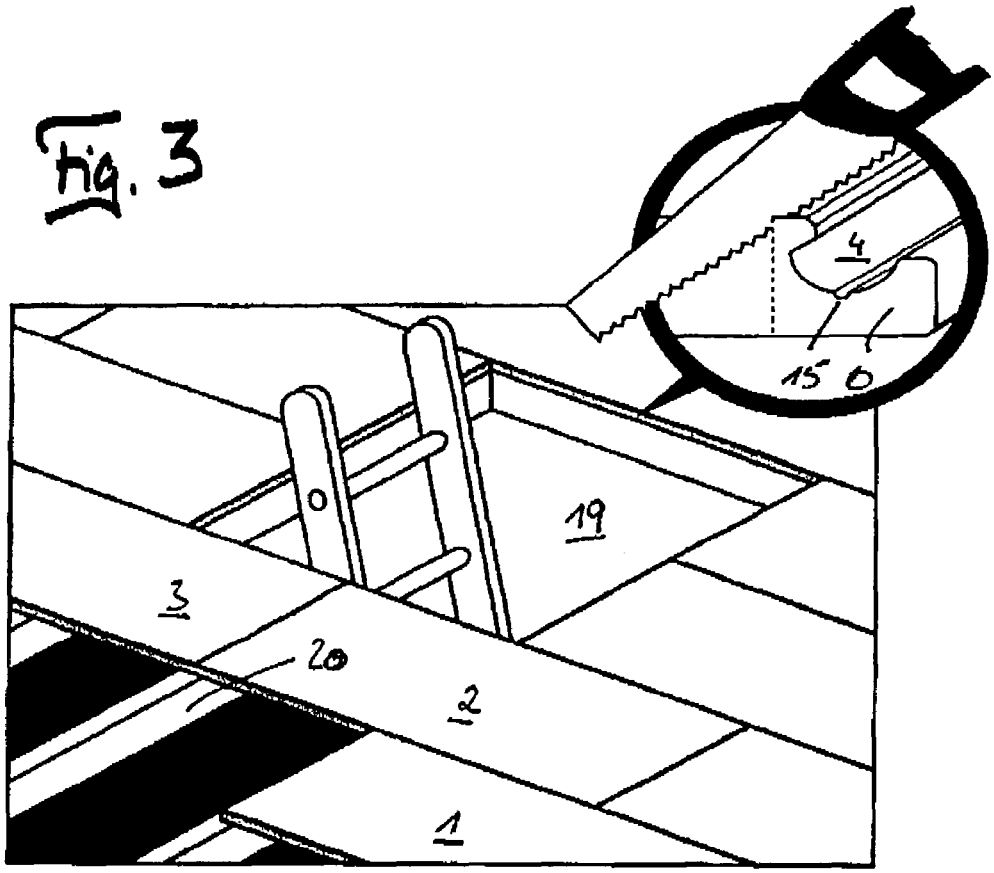
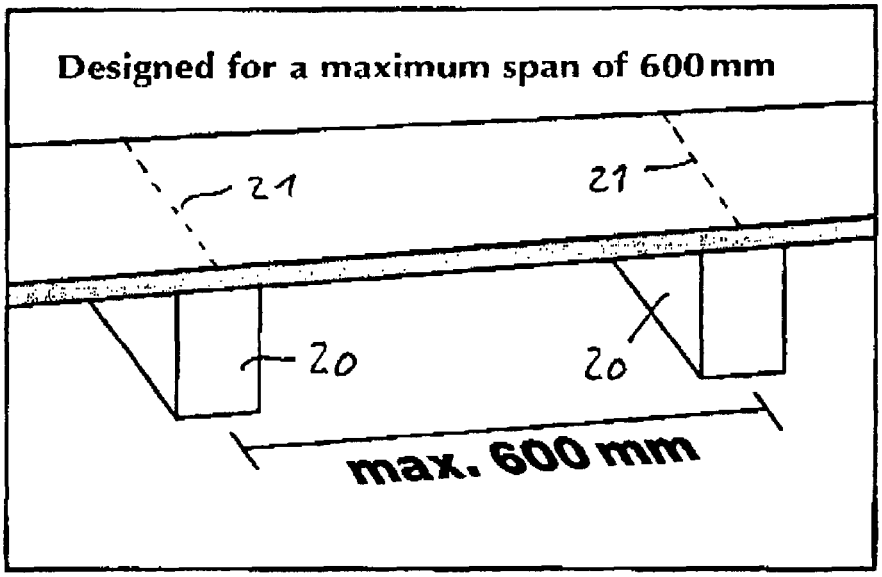
Fig. 4

BUILDING BOARD FOR USE IN SUBFLOORS

BACKGROUND OF THE INVENTION

1. Field of the Invention

The invention relates to a building board made of OSB (oriented strand board) which can be laid on beams, which are spaced apart parallel to one another, in order to form a subfloor in a residential or commercial building and which has two mutually opposite longitudinal edges and two mutually opposite transverse edges running at right angles to the longitudinal edges, one longitudinal edge and one transverse edge in each case having a tongue and the opposite longitudinal edge and transverse edge having a groove corresponding to the tongue, via which a plurality of building boards can be connected to one another and locked in the vertical direction in relation to one another.

2. Background Description

Subfloors are required when roof spaces in a house are being converted. The building boards are laid on the beams of the ceiling structure of the room beneath and are connected to these beams by being firmly nailed or screwed thereto. The building boards are provided with a tongue/groove profiling on their longitudinal and transverse sides. In order to produce a firm connection, the panels are glued to one another. For this purpose, a wood glue is introduced into the grooves of a panel which has already been laid and the tongue of a new panel is then pushed or driven into the groove, and the new panel is subsequently fastened on the beams.

The actual floor covering, for example parquet or laminate panels, is then laid on the resulting subfloor.

If the building boards are not laid very carefully, the tongue is not introduced all the way into the groove over its entire length. The longitudinal edges of the building boards then do not run parallel to one another. An offset of a few millimeters between two building boards is barely visible, in the first instance, to the naked eye. With each connection, however, the angle errors of the laid boards accumulate. Depending on the size of the room, the deviation from the right-angled state may then be a few centimeters, so that complicated sawing is necessary at the end in order to allow the last boards in the interlocking arrangement to adjoin the wall.

U.S. Pat. No. 4,426,820 discloses panels which are intended for forming a sports floor and are provided with a tongue/groove profiling both on the longitudinal side and on the transverse side. The cross section of the tongue corresponds to the cross section of the groove. Two panels may be connected to one another by virtue of the tongue side of one panel being placed, introduced and lowered into the groove side of the other panel. The panels are then locked in the horizontal direction both on the longitudinal sides and on the transverse sides. These panels are produced from plastic. Plastic has the property of allowing the groove and tongue profile to be injection molded at the same time as the panels are produced. Plastic also has the advantage of undergoing only small changes in dimension, if any at all, as a result of environmental influences.

SUMMARY OF THE INVENTION

These panels produced from plastic are not suitable for forming a subfloor since, on the one hand, they are fairly expensive to produce and, on the other hand, they cannot be produced in such a size as to allow them to be laid at the predetermined unit spacing of 600 mm for a ceiling structure. The formation of the tongue/groove profiling along the longitudinal and transverse sides, moreover, makes the panels very complicated to lay, which is very time-consuming and thus further increases the costs of a roof conversion.

The object of the invention is to develop an OSB building board for forming subfloors such that the boards can be reliably oriented parallel to one another and connected to one another, the intention being for the parallel state of the edges of the building boards to be maintained following connection.

In order to achieve the object, the building board of the generic type is distinguished in that the tongue and the groove on the longitudinal edge are designed such that two panels which are connected to one another at the longitudinal sides are also locked in a horizontal direction.

By virtue of this configuration, two boards latch in at the longitudinal edges. Adhesive bonding in the connection is not necessary. The locking ensures that there is no horizontal relative displacement in the direction of the connection, with the result that the parallel state of the longitudinal edges of two interconnected boards is always ensured. Complex sawing in the vicinity of the room walls is thus done away with.

The groove on the longitudinal edge is preferably bounded by a top lip and a bottom lip, the bottom lip projecting laterally beyond the top lip and having a concave recess over the entire length, and the tongue having a convex underside which corresponds to the recess. This configuration allows two panels simply to be pivoted one into the other. By virtue of the bottom lip and the underside of the tongue being rounded, the panels are connected to one another without being able to brace themselves against one another.

If the longitudinal edges and the transverse edges have a chamfer on their top side, with the result that a V-shaped joint is formed at the connecting location between two building boards, it is ensured that any fraying which may be caused by the strands at the locations where the boards are cut is removed and there are no disruptive protrusions when two boards are connected.

The board preferably comprises four layers, in which case, in the two outer layers, the longitudinal direction of the strands is oriented predominantly in the longitudinal direction of the board and, in the two inner layers, the longitudinal direction of the strands is oriented predominantly in the transverse direction of the board.

The strands are preferably glued with an isocyanate resin, a urea resin or a melamine resin.

If the top side of the boards is provided with markings, along which the boards can be fastened on the beams by means of screws or nails, the laying operation is simplified. The markings are provided at the predetermined unit spacing for the beams of, for example, 600 mm (standard dimension).

Preferably provided on the bottom lip of the groove, on the longitudinal and/or transverse side, are depressions, which are spaced apart parallel to one another and can accommodate a nail head or screw head, with the result that the means which fasten the building boards on the beams are fully countersunk.

BRIEF DESCRIPTION OF THE DRAWINGS

An exemplary embodiment of the invention will be explained in more detail hereinbelow with the aid of a drawing, in which:

FIG. 3 shows a not yet completed subfloor made of the building boards according to the invention; and FIG. 4 shows a partial illustration from FIG. 3.

DETAILED DESCRIPTION OF EMBODIMENTS OF THE INVENTION

Figure 1:
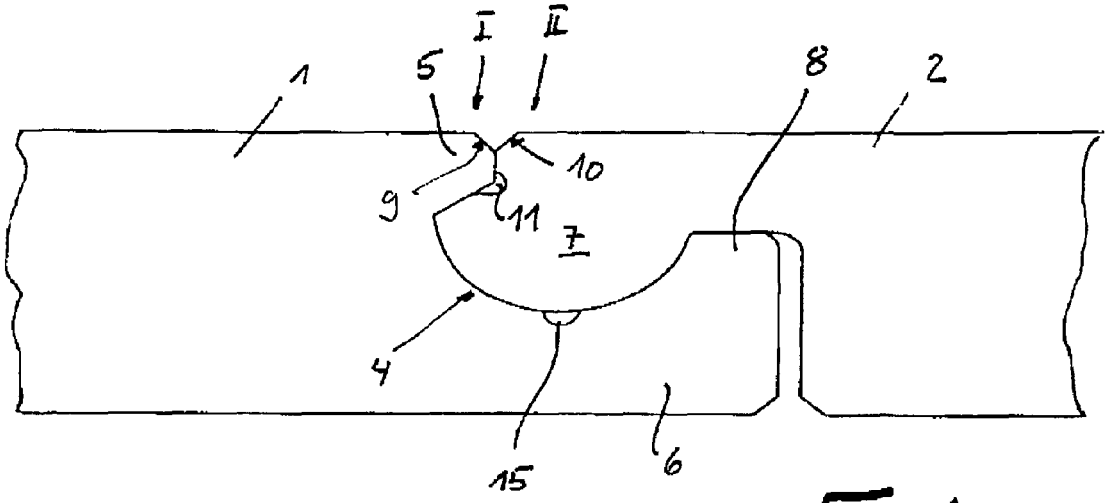
FIG. 1 shows a partial view of two building boards which are connected to one another at their longitudinal edges.

The building boards 1, 2, 3 comprise OSB (oriented strand boards). On one longitudinal edge I, the boards 1, 2 are provided with a groove 4, which is formed by a top lip 5 and a bottom lip 6. The bottom lip 6 projects laterally beyond the top lip 5. On the opposite longitudinal edge II, the boards 1, 2 are provided with a tongue 7 which corresponds to the groove 4. The top lip 5 of the groove 4 is inclined in the direction of the core of the board 1, with the result that the top lip 5 tapers in the outward direction. The front edge of the tongue 7 is bevelled in accordance with the underside of the top lip 5. As FIG. 1 shows, the bottom lip 6 is provided with a concave recess which corresponds to the convex underside of the tongue 7. Via the upwardly projecting extension 8 on the outer edge of the bottom lip 6, the interconnected boards 1, 2 are locked in the horizontal direction in relation to one another. In the direction of the top side, chamfers 9, 10 are provided on the edges I, II, this resulting in a V-shaped joint being produced at the connecting location between two interconnected boards. In order to avoid bracing at the connecting location, the tongue 7 is provided with a recess 11 at the end of its bevel corresponding to the top lip 5, and this recess serves as a dust pocket into which fine chippings can pass when the boards are being laid.

Figure 2:
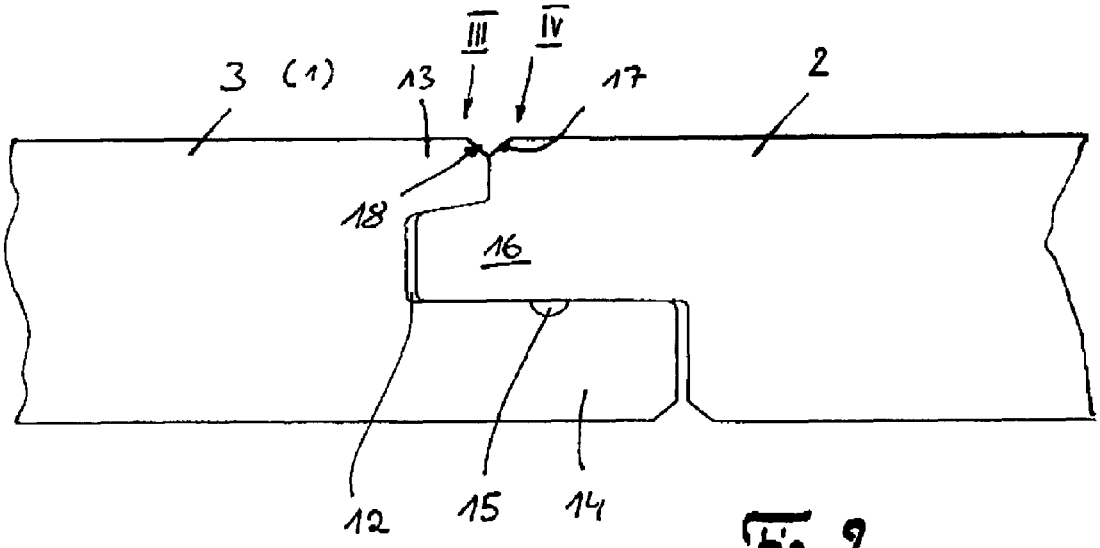
FIG. 2 shows a partial view of two building boards which are connected to one another on their transverse sides.

FIG. 2 shows two boards 2, 3 which are connected to one another at their transverse edges III, IV. The boards 1, 2, 3 are of identical configuration. On the transverse edge III, the boards 1, 2, 3 are provided with a groove 12, which is likewise formed by a top lip 13 and a bottom lip 14. The bottom lip 14 projects laterally beyond the top lip 13. The underside of the top lip 13 slopes slightly in the direction of the core of the board 3, with the result that the top lip 12 tapers outwards. The bottom lip 14—as is also the case with the bottom lip 6—is provided with a plurality of recesses 15 which are spaced apart parallel to one another and via which the boards 1, 2, 3 can be nailed or screwed to the beams 20 of the ceiling structure. The recesses 15 here accommodate the nail head or screw head, with the result that the fastening means can be fully countersunk in the bottom lip 14. On the opposite transverse edge IV, the boards 1, 2, 3 are provided with a tongue 16 which corresponds to the groove 12. The boards 2, 3 connected to one another at the transverse edges III, IV are not locked in the horizontal direction. It is also the case that chamfers 17, 18 are formed, in the direction of the top side of the boards, on the transverse edges III, IV with the result that two interconnected boards, 2, 3 also form a V-shaped joint on the transverse sides.

On the top side, the boards 1, 2, 3 are provided in the transverse direction with markings 21 corresponding to the standard spacing between the beams 20 of 600 mm, with the result that the boards 1, 2, 3 need not be fastened on the beams 20 immediately after they have been connected to one another, rather this can take place at a later stage once the entire subfloor has been produced. If access openings 19 are to be made in the subfloor, the tongues 7, 16 and grooves 4, 12 have to be sawn off beforehand, as is illustrated in FIG. 3.

The strands from which the board 1, 2, 3 is formed are distributed over four layers. In the two outer layers, their longitudinal direction is oriented in the direction of the longitudinal edges I, II of the boards 1, 2, 3. In the two central layers, the longitudinal direction of the strands is oriented in the direction of the transverse edges III, IV. This configuration gives rise to a high level of stability in the longitudinal direction of the boards in the cover layers. The chamfers 9, 10; 17, 18 provided along the edges I, II, III, IV result in any sawing-induced roughness produced by protruding strand parts being eliminated, with the result that there is no possibility of any prestressing at the connecting location between two interconnected boards.

The invention claimed is:

1. A building board made of OSB (oriented strand board) which can be laid on beams, which are spaced apart parallel to one another, in order to form a subfloor in a residential or commercial building and which has two mutually opposite longitudinal edges and two mutually opposite transverse edges running at right angles to the longitudinal edges, one longitudinal edge and one transverse edge in each case having a tongue and the opposite longitudinal edge and transverse edge having a groove corresponding to the tongue, via which a plurality of building boards can be connected to one another and locked in the vertical direction in relation to one another, wherein the tongue on the longitudinal edge comprises a bevel and a recess adjacent the bevel, wherein the bevel transitions into a flat surface of the recess, and the tongue and the groove on the longitudinal edge are designed such that two boards which are connected to one another at the longitudinal edges are also locked in a horizontal direction in relation to one another, wherein the groove on the longitudinal edge is bounded by a top lip and a bottom lip, the bottom lip projects laterally beyond the top lip and has a concave recess over the entire length, and the tongue has a convex underside which corresponds to the recess, and the bevel is a flat or planar and is conterminous with the convex underside of the tongue, the recess is defined by the flat surface and a curved surface formed in the tongue, in an assembled state, an edge of the top lip of a first said building board bounds the recess of a second said building board forming a closed space, an underside of the top lip comprises a beveled edge corresponding to the bevel, and the longitudinal edges and the transverse edges have a chamfer on their top side, with the result that a V-shaped joint is formed at the connecting location between two boards.

2. The building board as claimed in claim 1, wherein the board comprises four layers, in which case, in the two outer layers, a longitudinal direction of strands is oriented predominantly in the longitudinal direction of the board and, in the two inner layers, a longitudinal direction of other strands is oriented predominantly in the transverse direction of the board.

3. The building board as claimed in claim 1, wherein the board comprises strands glued with an isocyanate resin, a urea resin or a melamine resin.

4. The building board as claimed in claim 1, wherein the top side of the board is provided with markings, along which the board can be fastened on the beams by means of screws or nails.

5. The building board as claimed in claim 1, wherein the bottom lip of the groove, on the longitudinal and/or transverse side, has depressions, which are spaced apart parallel to one another, for accommodating a nail head or screw head.

6. A building board, comprising:

a first longitudinal edge having a tongue;

a second longitudinal edge opposite the first longitudinal edge and having a groove bounded by a top lip and a bottom lip;

a first transverse edge adjacent to the first and second longitudinal edges and having a tongue;

a second transverse edge adjacent to the first and second longitudinal edges and having a groove; and an upwardly projecting extension on the bottom lip of the second longitudinal edge that locks interconnected boards in a horizontal direction in relation to one another, wherein a front edge of the tongue of the first longitudinal edge comprises a bevel and a recess formed in the tongue adjacent to the bevel, the recess being defined by a flat surface and a curved surface formed in the tongue, the bevel is flat or planar, the bottom lip of the second longitudinal edge has a concave recess over its length, the tongue of the first longitudinal edge has a convex underside which corresponds to the concave recess, the bevel being conterminous with the flat surface of the recess and the convex underside of the tongue, the building board is made of oriented strand board (OSB), in an assembled state, a portion of the top lip of a first said building board is located within the recess of a second said building board, and further comprising a bevel on the top lip of the second longitudinal edge which corresponds to the bevel of the tongue of the first longitudinal edge.

7. The building board of claim 6, further comprising a first chamfer on a top side of the top lip of the second longitudinal edge.

8. The building board of claim 7, further comprising a second chamfer disposed above the tongue of the first longitudinal edge, resulting in a V-shaped joint formed by connecting boards.

9. The building board of claim 6, further comprising a plurality of spaced apart recesses provided along the bottom lip of the second longitudinal edge.

10. The building board of claim 9, wherein the groove of the second transverse edge comprises a top lip and a bottom lip, the bottom lip of the second transverse edge having a plurality of spaced apart recesses.

11. The building board of claim 10, wherein the plurality of recesses of the second longitudinal edge and the second transverse edge are configured to accommodate countersunk nail heads or screw heads.

12. The building board of claim 6, wherein:

a first layer and a second layer of the board comprise strands having a longitudinal direction oriented predominantly in a longitudinal direction of the board, and a third layer and a fourth layer of the board comprise strands having a longitudinal direction oriented predominantly in a transverse direction of the board.

13. The building board of claim 6, further comprising strands glued with one of an isocyanate resin, a urea resin, and a melamine resin.

14. The building board of claim 6, further comprising markings provided on a top side of the board and corresponding to spacing between beams.

15. A building board made of oriented strand board (OSB) comprising two mutually opposite longitudinal edges and two mutually opposite transverse edges running at right angles to the longitudinal edges, one longitudinal edge and one transverse edge in each case having a tongue and the opposite longitudinal edge and transverse edge having a groove corresponding to the tongue, via which a plurality of building boards can be connected to one another and locked in the vertical direction in relation to one another, wherein the groove on the longitudinal edge is bounded by a top lip and a bottom lip, the bottom lip projects laterally beyond the top lip and has a concave recess over the entire length, the tongue has a convex underside which corresponds to the concave recess, and the bottom lip has a plurality of spaced apart depressions formed in the concave recess and configured to accommodate a countersunk nail head or screw head, the tongue of the first longitudinal edge comprises a flat or planar bevel and a recess formed adjacent to the bevel, the recess being defined by a flat surface and a curved surface formed at a transition between the tongue and a vertical wall extending from the tongue, the flat or planar bevel being conterminous with the flat surface of the recess and the convex underside of the tongue, in an assembled state, a corner of the top lip of a first said building board is located within the recess of a second said building board, and an underside of the top lip comprises a beveled edge corresponding to the bevel.

16. The building board as claim in claim 1, wherein the tongue and the groove on the transverse edge are designed such that two boards which are connected to one another at the transverse edges are not locked in a horizontal direction in relation to one another.

17. The building board of claim 6, wherein the flat surface of the recess is substantially horizontal in the assembled state.

18. The building board of claim 15, further comprising a plurality of spaced apart recesses formed in a substantially flat surface of a bottom lip of the transverse edge.

19. The building board of claim 15, wherein the transverse edge is devoid of structure that locks, in a horizontal direction, two boards which are connected to one another.

20. The building board of claim 15, wherein the longitudinal edges and the transverse edges have a chamfer on their top side, with the result that a V-shaped joint is formed at the connecting location between two boards.

* * * * *